United States Patent [19]

Shaw et al.

[11] 4,302,190

[45] Nov. 24, 1981

[54] RIFLE RECOIL SIMULATOR

[75] Inventors: Bon F. Shaw, Winter Park; Albert H. Marshall, Orlando, both of Fla.

[73] Assignee: The United States of America as represented by the Secretary of the Navy, Washington, D.C.

[21] Appl. No.: 105,176

[22] Filed: Dec. 19, 1979

[51] Int. Cl.[3] ..... F41F 27/00

[52] U.S. Cl. ..... 434/18

[58] Field of Search ..... 35/25; 124/77, 55; 434/18

[56] References Cited

U.S. PATENT DOCUMENTS

| | | | |
|---|---|---|---|
| 2,304,320 | 12/1942 | Tratsch | 124/77 |
| 2,845,055 | 7/1958 | Collins et al. | 124/77 |
| 2,846,996 | 8/1958 | Drynan | 124/55 |
| 3,399,485 | 9/1968 | Cashavelly | 124/55 X |
| 4,050,166 | 9/1977 | Swiatosz et al. | 35/25 |
| 4,147,355 | 4/1979 | Barlow et al. | 273/310 X |
| 4,194,304 | 3/1980 | Wolcott | 35/25 |

OTHER PUBLICATIONS

Robert E. Simpson, *Introductory Electronics for Scientists and Engineers*, ©1974, pp. 441–444.

*Primary Examiner*—Richard C. Pinkham
*Assistant Examiner*—Scott L. Brown
*Attorney, Agent, or Firm*—Richard S. Sciascia; Robert W. Adams; David S. Kalmbaugh

[57] ABSTRACT

An apparatus for simulating the recoil motion of a weapon. The apparatus comprises a weapon having a trigger mechanism and an orifice located near the tip of the weapon. Whenever a trainee rifleman activates the trigger mechanism, timing means generates a trigger pulse. The trigger pulse, in turn, activates a two-way valve which allows a stream of compressed air to pass from a compressor to an intake port located on the weapon. The stream of compressed air is then passed through the orifice of the weapon so as to simulate the recoil motion of the weapon.

11 Claims, 2 Drawing Figures

RIFLE RECOIL SIMULATOR

BACKGROUND OF THE INVENTION

1. Field of the Invention

This invention relates generally to training simulators. In particular, this invention relates to an apparatus for simulating the recoil motion of a weapon.

2. Description of the Prior Art

A variety of devices are available for simulating the recoil motion of a weapon. Such devices of the prior art have been realized through mechanical, electrical, or hydraulic means, and combinations thereof. However, such devices of the prior art ordinarily leave something to be desired, especially from the standpoints of recoil motion accuracy, design complexity, and limiting the movement of a trainee rifleman when firing the weapon.

In particular, mechanical devices which act on the weapon externally limit the mobility of the trainee rifleman, and generate an inaccurate recoil motion which varies with the direction the weapon is pointed. Further, electro-mechanical devices provide inaccurate recoil motion, limit the mobility of the trainee rifleman, and are complex in design. And, electrical devices, which require relatively large components and draw large amounts of current, are very complex and extremely cumbersome, thereby limiting the movement of the trainee rifleman.

SUMMARY OF THE INVENTION

The subject invention overcomes some of the disadvantages of the prior art, including those mentioned above, in that it comprises a relatively simple apparatus for simulating the recoil motion of a weapon. The apparatus comprises a weapon having a trigger mechanism and a barrel, with the barrel having an orifice near the tip thereof. Whenever a trainee rifleman activates the trigger mechanism by firing the weapon, a timer generates a trigger pulse. The trigger pulse, in turn, activates a two-way valve which allows a stream of compressed air to pass from a compressor to an intake port located on the weapon. The stream of compressed air is then passed through the orifice of the weapon, thereby causing a force to be exerted upon the barrel of the weapon so as to simulate the recoil motion of the weapon.

DESCRIPTION OF THE PREFERRED EMBODIMENT

The subject invention will be utilized in the U.S. patent application entitled Electro-Optic Infantry Weapons Trainer, by Albert H. Marshall, Bon F. Shaw, Herbert C. Towle, and Thomas S. Riordan, Ser. No. 105,313, filed concurrently with this pending application.

Figure 1:
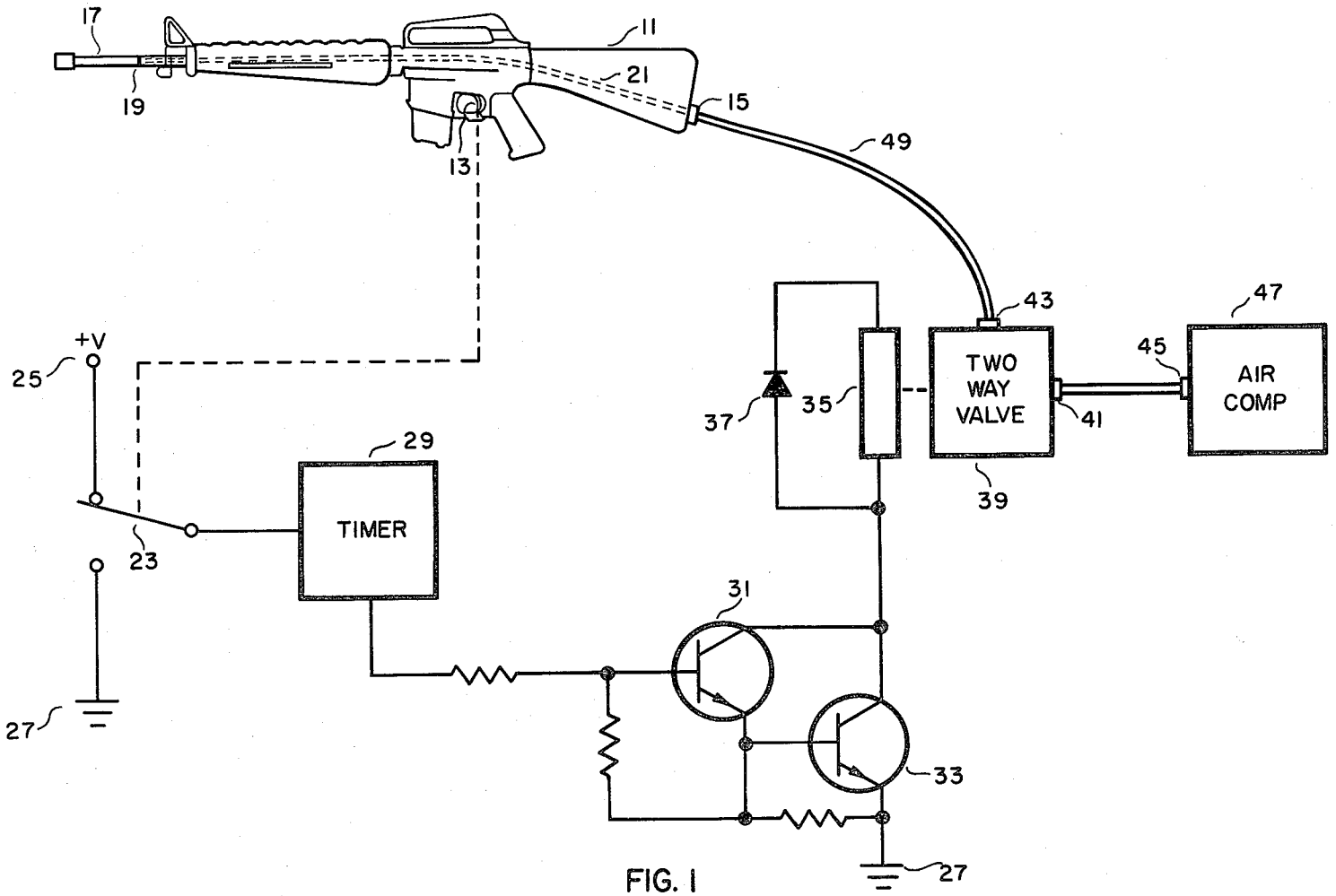
FIG. 1 is a schematic diagram of the subject invention.

Referring now to FIG. 1, there is shown a weapon 11, which may of course be any conventional rifle. Weapon 11 includes a trigger mechanism 13, an intake port 15, and a barrel 17 with an orifice 19 located near the tip thereof. Effectively connected between orifice 19 and intake port 15 is an internal hose 21.

A trigger switch 23 is mechanically connected to trigger mechanism 13. The first input of trigger switch 23 is connected to a direct current voltage source 25, the second input of trigger switch 23 is connected to a ground 27, and the output thereof is connected to the input of a timer 29. The output of timer 29 is connected to the base of an NPN transistor 31, the emitter of which is connected to the base of an NPN transistor 33. The collectors of NPN transistors 31 and 33 are, in turn, connected to the first of the pair of terminals of a solenoid 35. In addition, the emitters of NPN transistors 31 and 33 are connected to ground 27. Effectively connected between the pair of terminals of solenoid 35 is a diode 37.

At this time it may be noted that NPN transistors 31 and 33 are connected so as to form a darlington pair circuit.

Solenoid 35 is mechanically connected to a two-way valve 39 which includes an intake port 41 and an output port 43. Intake port 41 is effectively connected to an output port 45 of an air compressor 47. Output port 43 is connected by an external hose 49 to intake port 15 of weapon 11.

At this time it may be noted that two-way valve 39 may be any conventional air pilot valve and is commercially available from several different sources. In particular, it has been found that an air pilot valve which includes a solenoid, Model 2431A211601D, manufactured by MAC Valve, Inc. of Wiscom, Mich., performs quite satisfactorily as solenoid 35 and two-way valve 39.

Also, it may be mentioned at this time that all of the elements, including those mentioned above, which comprise the subject invention are well known, conventional, and commercially available.

The operation of the subject invention will now be discussed in conjunction with the figures of the drawing.

Figure 2:
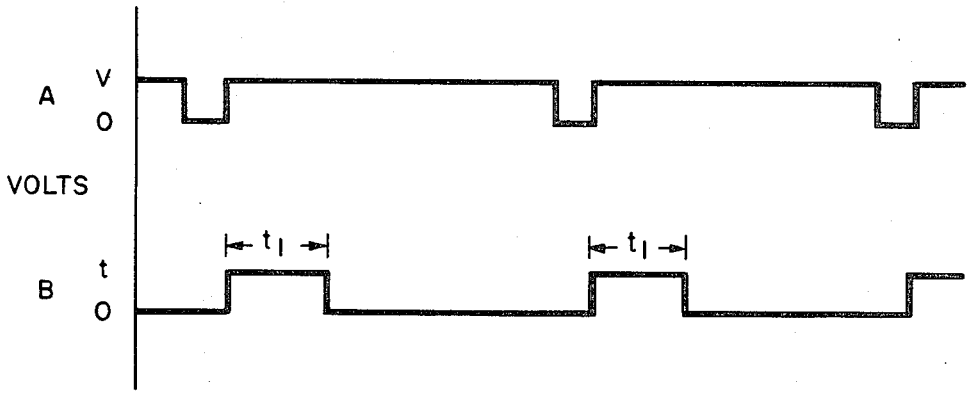
FIG. 2 is a graphical representation of the various waveforms which occur at the outputs of some of the elements of FIG. 1.

Referring to FIG. 1, whenever a trainee rifleman, not shown, pulls trigger mechanism 13 so as to fire weapon 11, trigger switch 23 supplies a trigger signal, similar to that of FIG. 2(A), to the input of timer 29. Timer 29, in turn, generates a trigger pulse, similar to that of FIG. 2(B), having a time period $t_1$ of twenty milliseconds. Selection of the time period $t_1$ for the trigger pulse of FIG. 2(B) was necessary so as to allow weapon 11 to be fired in an automatic mode at a rate of twelve cycles per second.

At this time it may also be noted that a one-shot multivibrator may be utilized as timer 29 to generate the trigger pulse of FIG. 2(B).

The trigger pulse of FIG. 2(B) is supplied to the base of NPN transistor 31 so as to turn on NPN transistor 31. NPN transistor 31 then turns on NPN transistor 33 so as to activate solenoid 35 for a time period of approximately twenty milliseconds.

As mentioned previously, NPN transistors 31 and 33 are connected so as to form a darlington pair circuit which provides the necessary current gain to activate solenoid 35. Solenoid 35 opens the two-way valve 39 so as to allow a stream of compressed air provided by air compressor 47 to pass from air compressor 47 to intake port 15 of weapon 11. The stream of compressed air then passes through internal hose 21 to orifice 19 and exits therefrom, so as to force barrel 17 upward and to the right, thus simulating the recoil motion of a rifle when fired by the trainee rifleman, not shown.

From the foregoing, it may readily be seen that the subject invention comprises a new, unique, and exceedingly useful rifle recoil simulator which constitutes a considerable improvement over the known prior art Obviously, many modifications and variations of the present invention are possible in light of the above teachings. It is, therefore, to be understood that within the scope of the appended claims the invention may be practiced otherwise than as specifically described.

What is claimed is:

1. A recoil motion apparatus comprising in combination:

a voltage source;

a weapon having a trigger mechanism, an intake port, and a barrel, the barrel of said weapon having an orifice located near the tip thereof;

switching means effectively connected to the trigger mechanism of said weapon, and having a first input connected to said voltage source, a second input connected to ground, and an output for providing a trigger signal whenever a trainee rifleman activates the trigger mechanism of said weapon;

timing means having an input connected to the output of said switching means and an output for generating a trigger pulse having a predetermined time period in response to the trigger signal provided by said switching means;

compressor means having an output port for providing a stream of compressed air;

valve means having an intake port connected to the output port of said compressor means, an output port connected to the intake port of said weapon for passing therethrough, whenever the trigger mechanism of said weapon is activated, the stream of compressed air provided by said compressor means to the intake port of said weapon; and solenoid means connected to said valve means and having a pair of terminals, with one of said pair of terminals connected to the output of said timing means for effecting the opening of said valve means in response to the trigger pulse provided by said timing means so as to allow the stream of compressed air provided by said compressor means to pass through the orifice of said weapon, said orifice being located so that the stream of air passing through said orifice will force the barrel of said weapon upward and to the right, so as to cause said weapon to recoil.

2. The recoil motion apparatus of claim 1, wherein said weapon comprises a rifle.

3. The recoil motion apparatus of claim 1, wherein said timing means comprises:

a timer having an input connected to the output of said switching means, and an output;

a first NPN transistor having a base connected to the output of said timer, an emitter, and a collector; and a second NPN transistor having a base connected to the emitter of said first NPN transistor, and a collector connected to the collector of said first NPN transistor.

4. The recoil motion apparatus of claim 1, wherein said timing means comprises:

a one-shot multivibrator having an input connected to the output of said switching means, and an output;

a first NPN transistor having a base connected to the output of said one-shot multivibrator, an emitter, and a collector; and a second NPN transistor having a base connected to the emitter of said first NPN transistor, and a collector connected to the collector of said first NPN transistor.

5. The recoil motion apparatus of claim 1, further characterized by an external hose connected between the output port of said valve means and the intake port of said weapon.

6. The recoil motion apparatus of claim 1, further characterized by a diode connected between the pair of terminals of said solenoid.

7. A rifle recoil simulator comprising in combination:

a direct current voltage source;

a weapon having a trigger mechanism, an intake port, a barrel, the barrel of said weapon having an orifice located near the tip thereof, and an internal hose connected between the intake port and the orifice of said weapon;

a trigger switch effectively connected to the trigger mechanism of said weapon, said trigger switch having a first input connected to said direct current voltage source, a second input connected to a ground, and an output for providing a trigger signal whenever a trainee rifleman activates the trigger mechanism of said weapon;

a timer having an input connected to the output of said trigger switch, and an output for generating a trigger pulse having a predetermined time period in response to the trigger signal provided by said trigger switch;

a darlington pair circuit having an input connected to the output of said timer, and an output for amplifying the trigger pulse provided by said timer;

a compressor having an output port for providing a stream of compressed air;

a two-way valve having an intake port connected to the output port of said compressor, and an output port connected to the intake port of said weapon for passing therethrough, whenever the trigger mechanism of said weapon is activated, the stream of compressed air provided by said compressor to the intake port of said weapon; and a solenoid connected to said two-way valve and having a pair of terminals, with one of said pair of terminals connected to the output of said darlington pair circuit for effecting the opening of said two-way valve in response to the trigger pulse provided by said timer so as to allow the stream of compressed air provided by said compressor to pass through the orifice of said weapon, said orifice being located so that the stream of air passing through said orifice will force the barrel of said weapon upward and to the right so as to cause said weapon to recoil.

8. The rifle recoil simulator according to claim 7, wherein said weapon comprises a rifle.

9. The rifle recoil simulator according to claim 7, wherein said darlington pair circuit comprises:

a first NPN transistor having a base connected to the output of said timer, an emitter, and a collector; and a second NPN transistor having a base connected to the emitter of said first NPN transistor, and a collector connected to the collector of said first NPN transistor.

10. The rifle recoil simulator according to claim 7, further characterized by an external hose connected between the output port of said two-way valve and the intake port of said weapon.

11. The rifle recoil simulator according to claim 7, further characterized by a diode connected between the pair of terminals of said solenoid.

* * * * *